US007255581B2

(12) United States Patent
Yamaoka

(10) Patent No.: US 7,255,581 B2
(45) Date of Patent: Aug. 14, 2007

(54) LEVER-TYPE CONNECTOR

(75) Inventor: Atsushi Yamaoka, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/443,916

(22) Filed: May 31, 2006

(65) Prior Publication Data

US 2006/0281351 A1 Dec. 14, 2006

(30) Foreign Application Priority Data

Jun. 8, 2005 (JP) ..... 2005-168430

(51) Int. Cl.
*H01R 13/62* (2006.01)

(52) U.S. Cl. ..... 439/157

(58) Field of Classification Search ..... 439/157, 439/352, 357, 351, 489, 152–160; 175/65 SS
See application file for complete search history.

(56) References Cited

U.S. PATENT DOCUMENTS 5,474,461 A * 12/1995 Saito et al. ..... 439/157
5,695,349 A * 12/1997 Taguchi et al. ..... 439/157
5,823,809 A * 10/1998 Wakata ..... 439/157
5,938,470 A * 8/1999 Kashiyama ..... 439/489
5,997,321 A * 12/1999 Nakata et al. ..... 439/157
6,319,050 B1 * 11/2001 Miyazaki et al. ..... 439/489
6,840,790 B2 * 1/2005 Endo et al. ..... 439/352
7,052,294 B1 * 5/2006 Osada ..... 439/157
7,172,442 B2 * 2/2007 Fukatsu ..... 439/157
2003/0054681 A1 * 3/2003 Hatagishi et al. ..... 439/157
2006/0270258 A1 * 11/2006 Ohtaka et al. ..... 439/157

FOREIGN PATENT DOCUMENTS

JP 5-90845 12/1993

* cited by examiner

*Primary Examiner*—Alexander Gilman
(74) *Attorney, Agent, or Firm*—Gerald E. Hespos; Anthony J. Casella

(57) ABSTRACT

A flexible lock (50) is disposed on a side plate (41) of a lever (12) within a thickness of the side plate (41). The flexible lock (50) can elastically deform toward or away from a side wall of a male housing (10). A locking portion (51) on an inner surface of the flexible lock (50) is locked to a lock-receiving portion (52) on an outer surface of the male housing (10) to lock the lever (12) at a fit-in position. The lever (12) does not project out from the lever (12) in a thickness direction thereof. Thus a connector is compact in its widthwise direction. An unlocking portion (53) for unlocking the lever (12) at the fit-in position is nearer an operation portion (42) of the lever (12).

12 Claims, 15 Drawing Sheets

LEVER-TYPE CONNECTOR

BACKGROUND OF THE INVENTION

1. Field of the Invention

The invention relates to a lever-type connector.

2. Description of the Related Art

Japanese Utility Model Application Laid-Open No. 5-90845 discloses a lever-type connector with first and second housings and a lever mounted rotatably to the first housing. The lever has an operation portion and side plates that extend from opposite ends of the operation portion. Thus, the lever is U-shaped and straddles the first housing. The side-plates of the lever have cam grooves that receive cam pins on the second housing. The cam pins move along the cam grooves as the lever is rotated and urge the housings together. A housing-side locking claw projects out from an outer surface of the first housing and locks to a lever-side lock on the side plate of the lever when the housings have been fit together. The lever-side lock engages the lever-side locking claw from the outside. Thus, the locking arm of the lever-side lock must project out from the lever, and the connector is wide.

The invention has been completed in view of the above-described situation and an object of the invention to provide a lever-type connector that can be miniaturized and that provides excellent unlocking performance.

SUMMARY OF THE INVENTION

The invention relates to a lever-type connector with first and second housings and a lever. The lever has an operation portion and a side plate extends from the operation portion. The side plate is mounted rotatably on the first housing. A cam groove is formed in the side plate and receives a cam pin formed on the second housing. The cam pin moves along the cam groove as the lever is rotated to fit the housings together. A seesaw-shaped flexible lock is formed within a thickness of the side plate and can deform elastically towards and away from the first housing. A locking portion is formed on an inner surface of a first end of the flexible lock and locks to a lock receiving portion on an outer surface of the first housing when the first and second housings are fit normally together to lock the lever.

The lock for the prior art lever is on the outer surface of the lever and the lock receiving portion of the prior art housing projects out in the thickness direction of the lever. On the other hand, the locking portion of the lever of the subject invention is on the inner surface of the lever. Therefore, the lock receiving portion of the housing need not project out, and the housing is narrow. Further, the flexible lock of the lever lies within the thickness of the lever, and therefore, the lever also is narrow.

An unlocking portion is formed on the second end of the flexible lock and can be pressed to unlock the lock from the lock receiving portion. The operator then can rotate the lever to separate the housings. The unlocking portion is between the operation portion and the rotational center, but is closer to the operation portion. Thus, the operator can easily unlock and rotate the lever.

The flexible lock preferably is formed in an annular slit in the side plate of the lever. A hinge connects the flexible lock to the side plate and is between the rotational center of the lever and the operation portion.

The flexible lock for the lever could project from an edge of the side plate along the surface thereof. However, this construction causes the rotational locus of the lever to be large and hence the housing is large to prevent the projection from being included in the rotational locus of the lever. However, the flexible lock of the invention is within the thickness of the lever. Therefore, neither the rotational locus of the lever nor the housing is large.

DETAILED DESCRIPTION OF THE PREFERRED EMBODIMENTS

A lever type connector according to the invention has a male housing 10, a female housing 11 and a lever 12 mounted on the male housing 10. The lever 12 can be operated to fit the female housing 11 into the male housing 10 or to separate the male and female housings 10, 11. Ends of the male and female housings 10 and 11 that connect to one another are referred to herein as the front ends.

Figure 2:
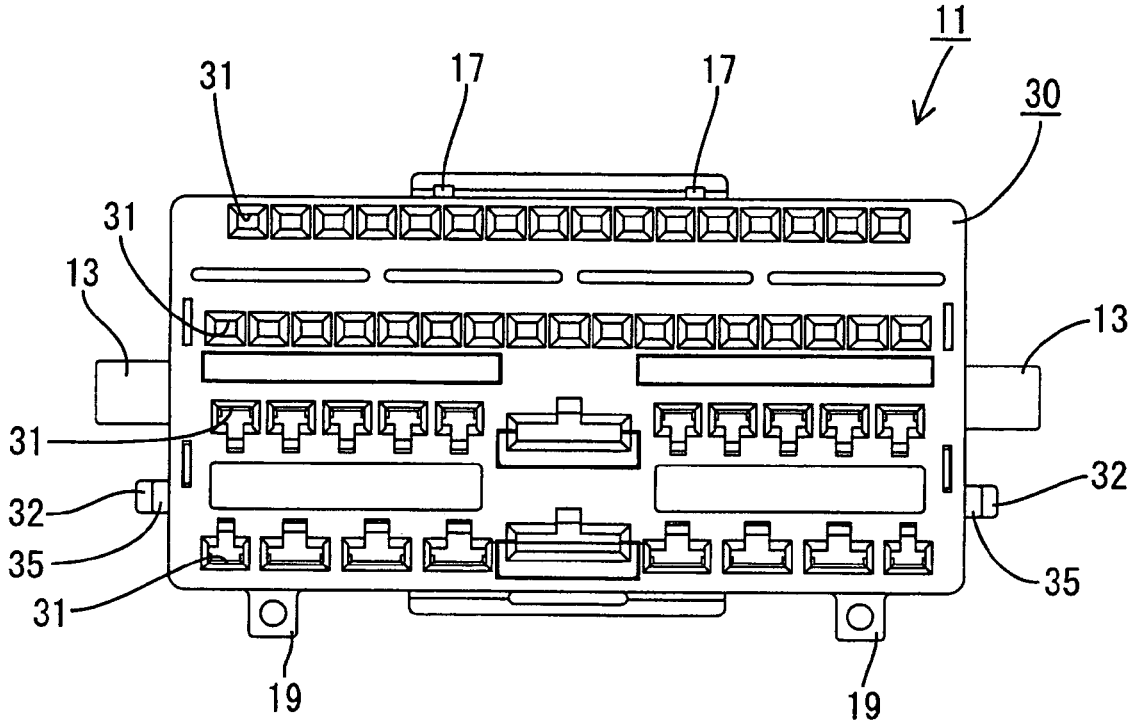
FIG. 2 is a front view showing the female housing of a lever-using type connector according to one embodiment of the present invention.
Figure 3:
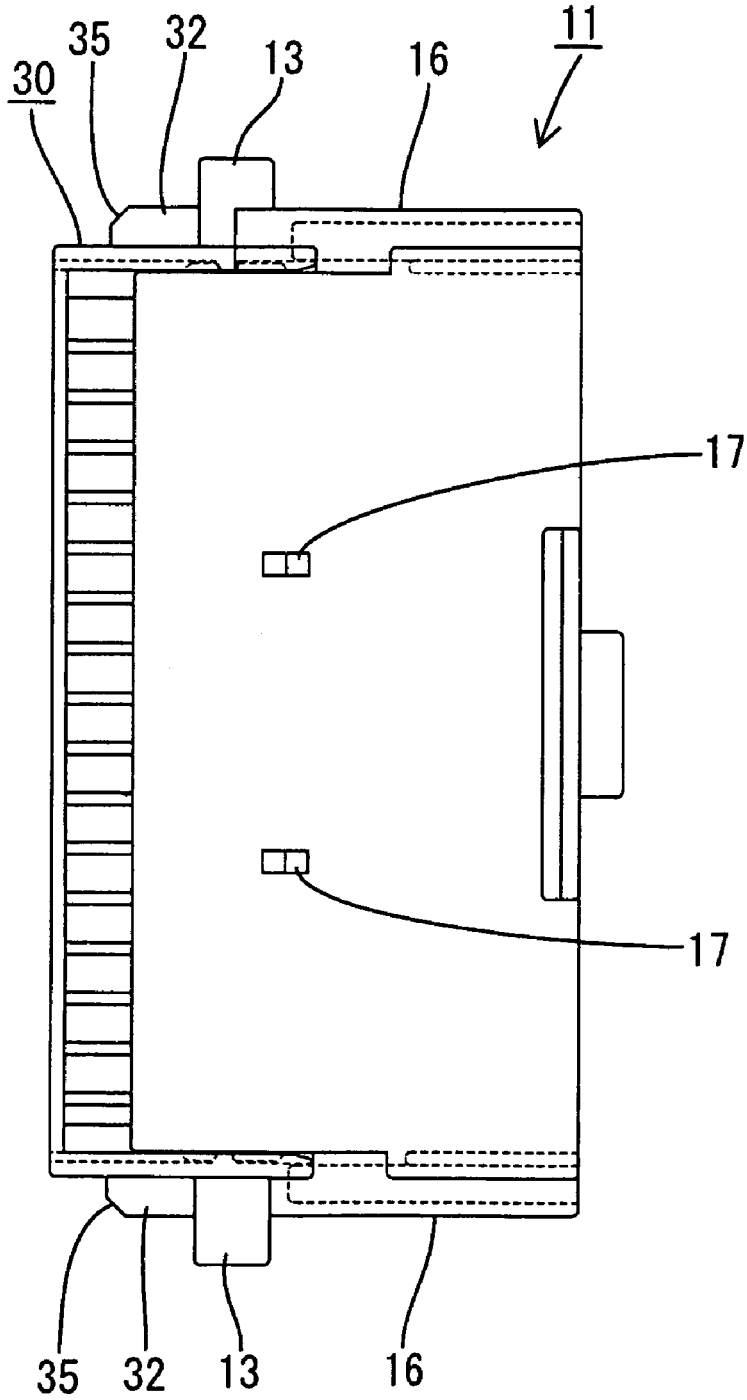
FIG. 3 is a plan view showing the female housing.
Figure 4:
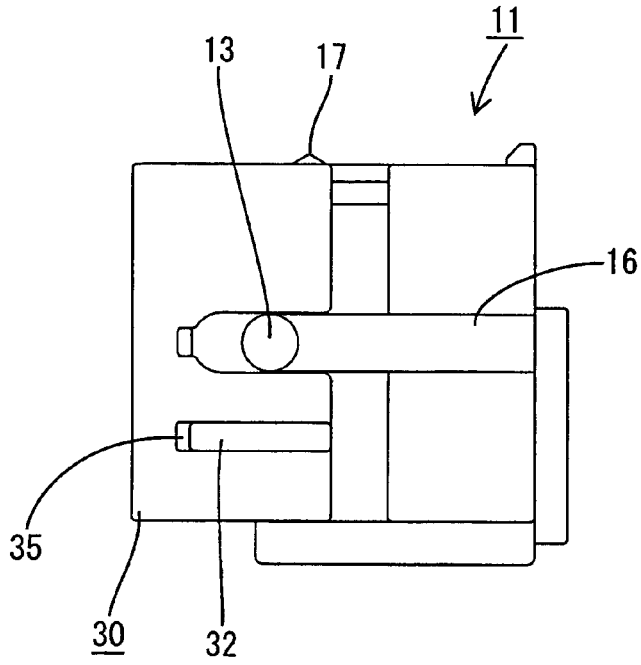
FIG. 4 is a side view showing the female housing.

As shown in FIGS. 2 through 4, the female housing 11 is made of a synthetic resin and is approximately block-shaped. Two approximately columnar cam pins 13 project out from a front end of an outer surface of a side wall of the female housing 11 in approximately the center of the side wall in a height direction. The cam pins 13 advances into first guide slits 15 formed on the male housing 10 and move longitudinally to guide the male and female housings 10 and 11 in fit-in and separation operations. The cam pins 13 also engage cam grooves 14 on the lever 12 as described further below. A side guide rib 16 extends longitudinally rearward from each of the cam pins 13. The side guide ribs 16 advance into the first guide slits 15 for further guiding the female housing 11 and the male housing 10 in the fit-in and separation operations. Two upper guide projections 17 project on an outer surface of an upper wall of the female housing 11 and are mountain-shaped in side view. The guide projections 17 advance into upper guide slits 18 formed in an upper wall of the male housing 10 to guide the male and female housings 10 and 11 in the fit-in and separation operations. Two lower guide ribs 19 are formed longitudinally on an outer surface of a lower wall of the female housing 11 at positions near the widthwise sides of the lower wall. The lower guide ribs 19 advance in lower guide grooves 20 for further guiding the housings 10 and 11 in the fit-in and separation operations.

Figure 11:
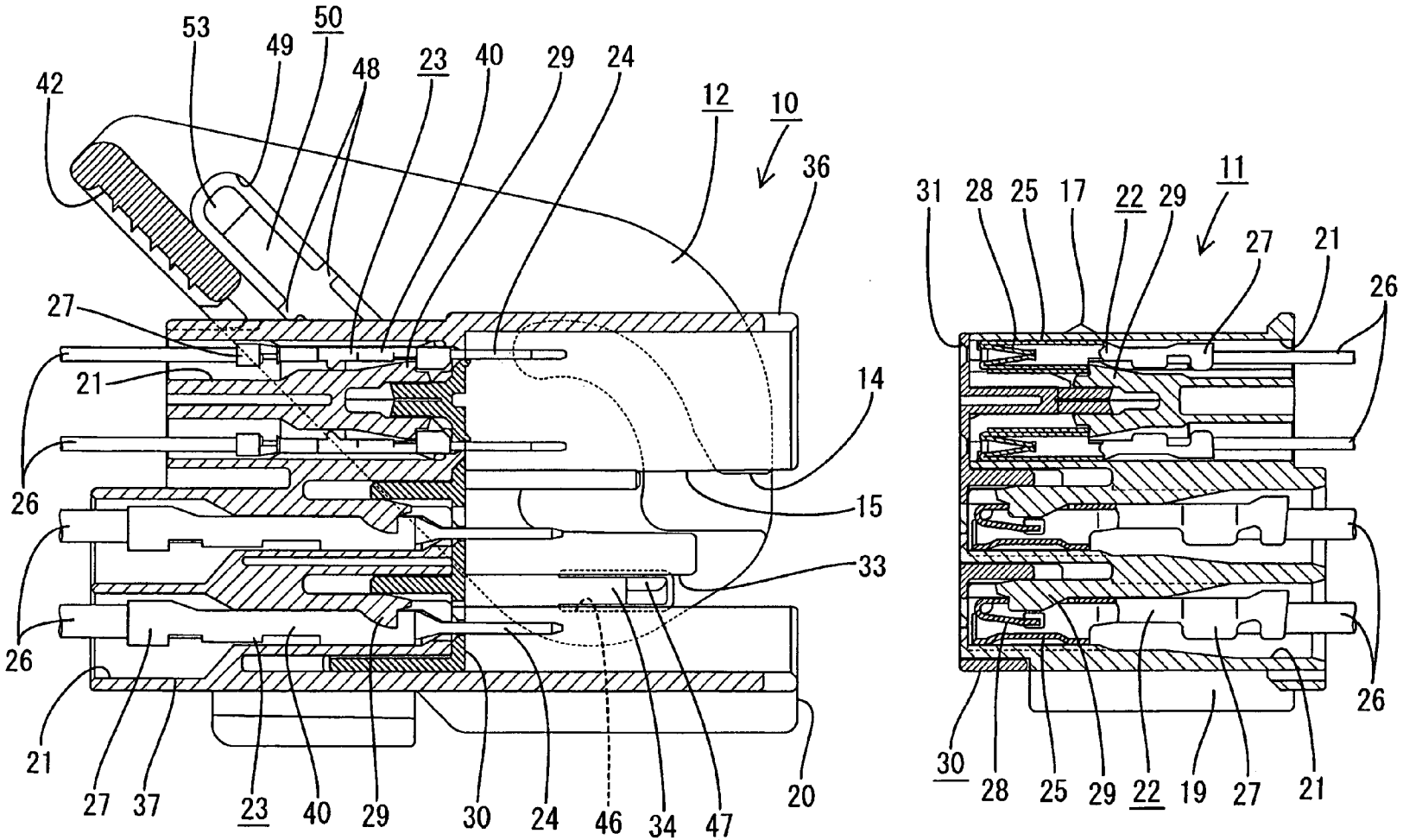
FIG. 11 is a sectional view showing the male housing on which the lever is mounted and the female housing.

Cavities 21 are formed longitudinally in the female housing 11, as shown in FIG. 11, and female terminal fittings 22 are inserted into the cavities 21 from the rear. Each female terminal fitting 22 has an approximately square tubular body 25 for receiving a tab 24 of a male terminal fitting 23. A barrel 27 is disposed rearward of the body 25 and is configured for crimped engagement with an electric wire 26. An elastically deformable contact 28 is formed inside the tubular body 25 and elastically contacts the tab 24 inserted into the tubular body 25. An elastically deformable lance 29 is cantilevered forward from an inner wall of each cavity 21. The lance 29 engages the tubular body 25 to prevent the female terminal fitting 22 from slipping rearwardly out of the cavity 21.

A cap-shaped retainer 30 is mounted from the front on a front end of the female housing 11 and is movable between a temporary locking position and a main locking position with respect to the female housing 11. The female terminal fittings 22 can be inserted into the cavities 21 or removed therefrom when the retainer is at the temporary locking position (see FIG. 4). However, the female terminal fittings 22 are prevented from slipping out of the cavities 21 when the retainer 30 is at the main locking position (see FIG. 1). More particularly, the retainer 30, at the main locking position, enters an elastically deformable space of the lance 29 to prevent the lance 29 from deforming away from the female terminal fitting 22. Thus, the female terminal fitting 22 is locked redundantly. Tab insertion holes 31 are formed at positions corresponding to the cavities 21 and are dimensioned to receive the tabs 24. Two longitudinally-extending retainer guide ribs 32 project out from an outer surface of a side wall of the retainer 30 at positions higher than the lower end of the retainer 30 by about ¼ of the height of the retainer 30. The retainer guide ribs 32 advance into second side guide slits 33 formed on the side walls of the male housing 10 to guide the male and female housings 10 and 11 in the fit-in and separation operations. A tapered surface 35 is formed at a front end of each retainer guide rib 32 to allow a temporary lock 34 of the lever 12 to ride easily over the retainer guide rib 32.

Figure 5:
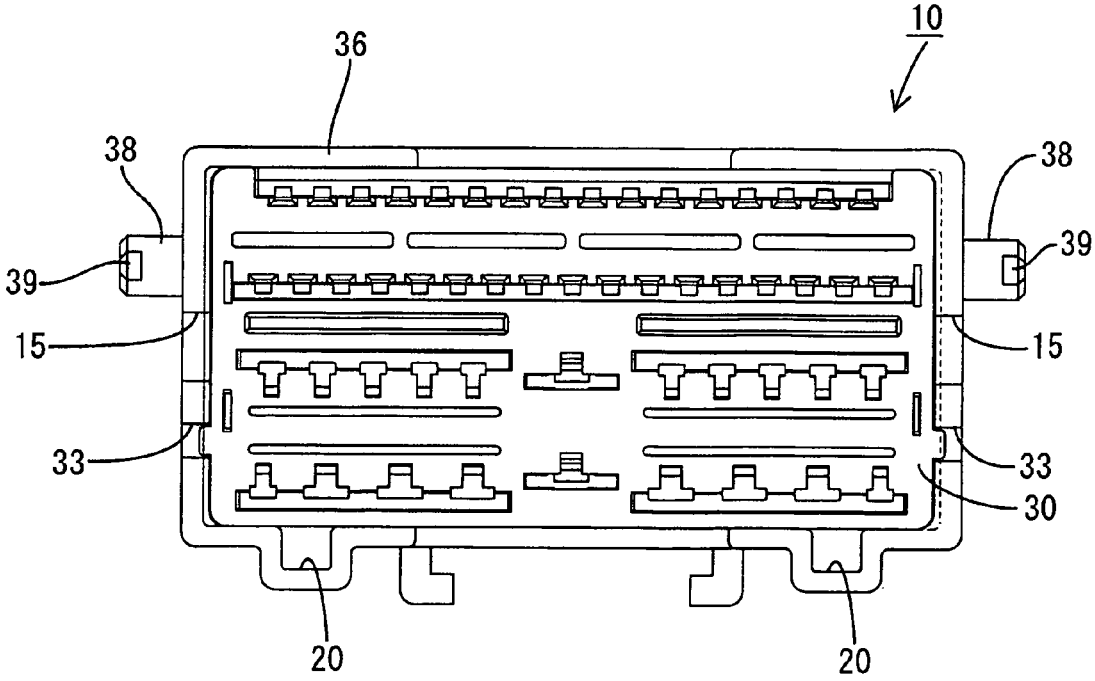
FIG. 5 is a front view showing the male housing.
Figure 6:
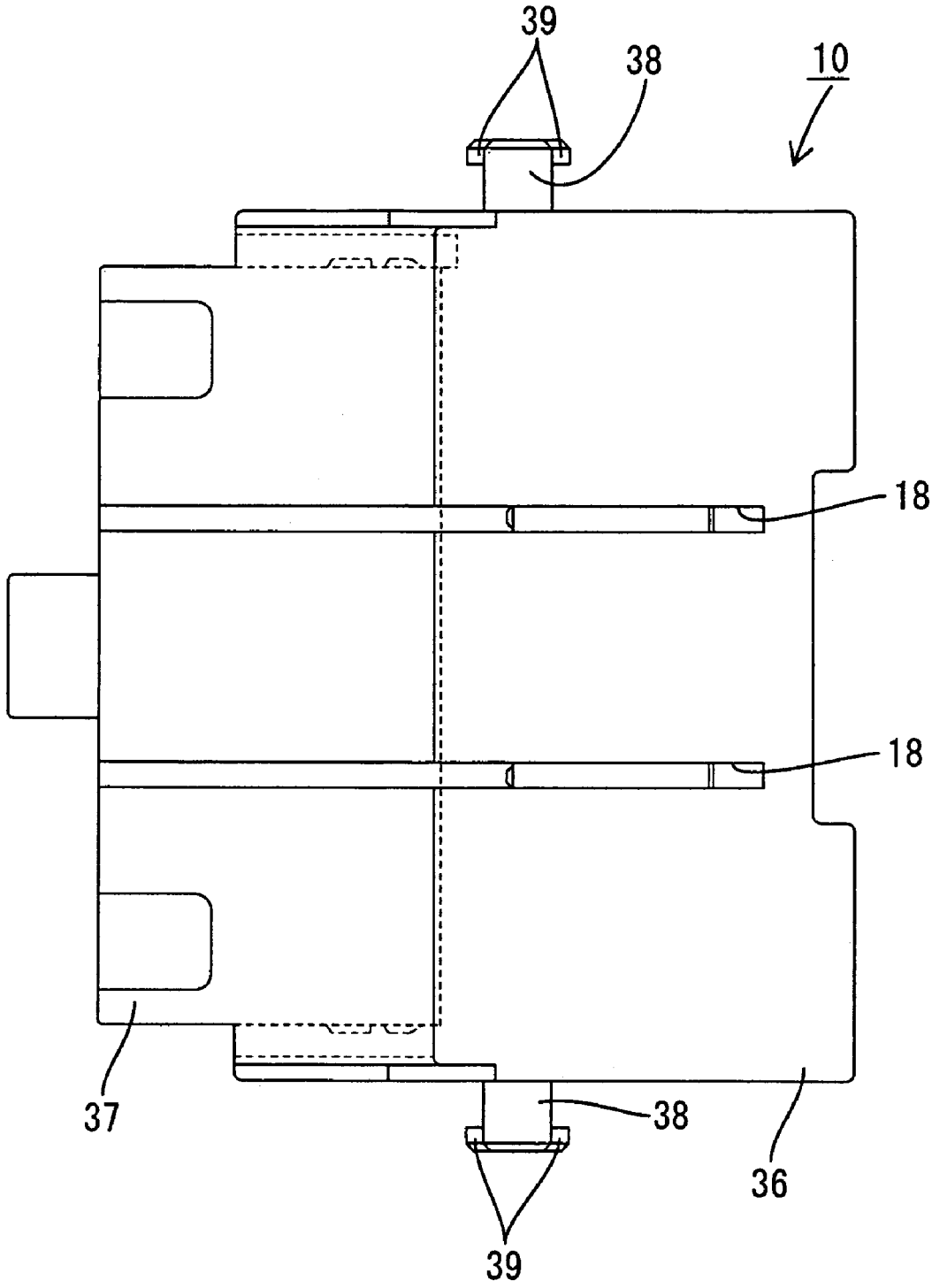
FIG. 6 is a plan view showing the male housing.
Figure 7:
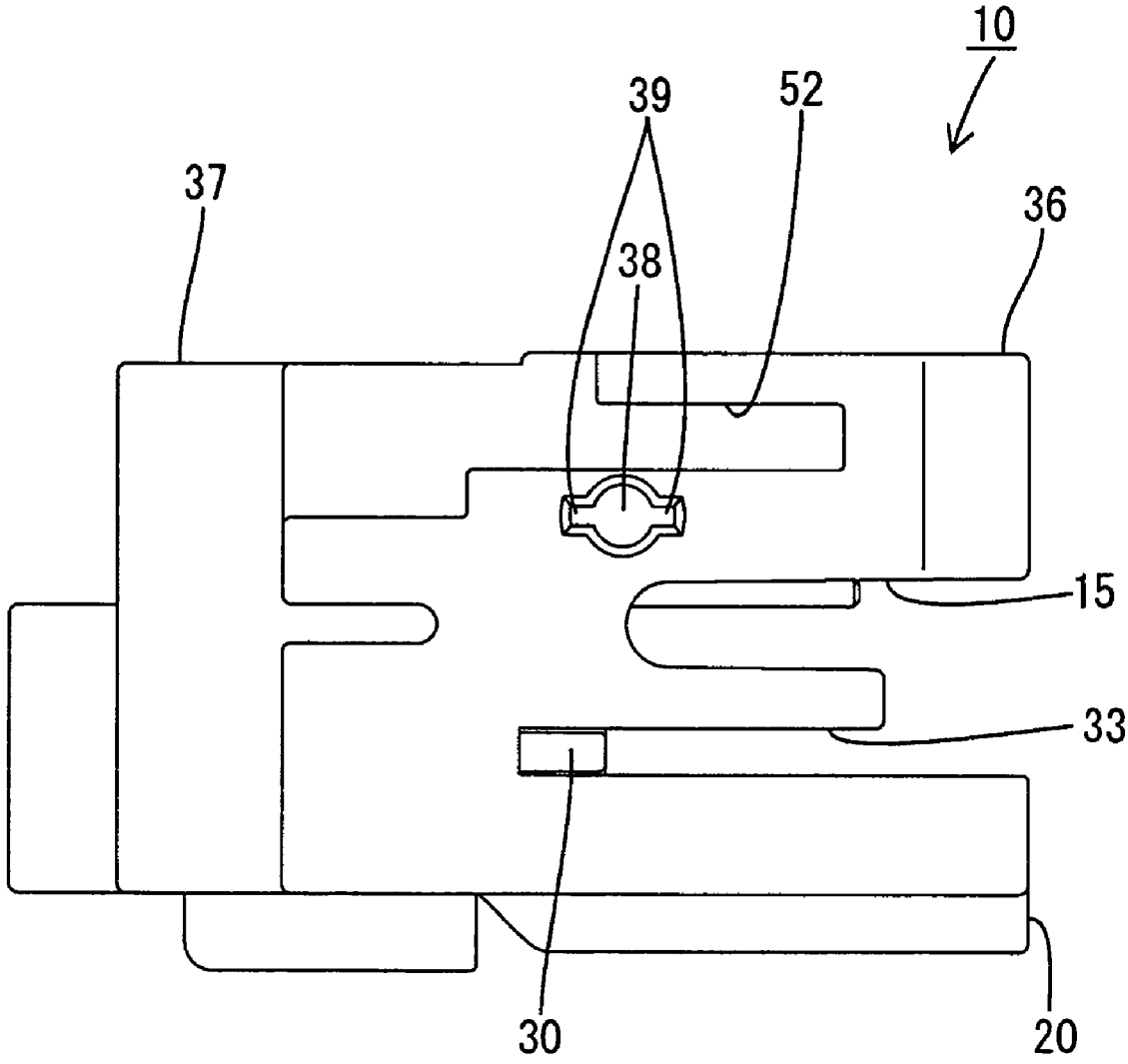
FIG. 7 is a side view showing the male housing.

The male housing 10 is made of a synthetic resin. As shown in FIGS. 5 through 7, a forwardly open hood 36 is formed at the front end of the male housing 10 and a terminal accommodation part 37 is formed rearward from the hood 36 for accommodating the male terminal fittings 23. Substantially cylindrical shafts 38 project out from approximately longitudinal center positions on the outer surfaces of the side walls of the male housing 10 and slightly higher than the vertical center of the side walls. The shafts 38 are configured for receiving the lever 12. Two projections 39 are formed at the distal end of each of the shafts 38.

The two upper guide slits 18 are formed at positions on an upper wall of the hood 36 matching the upper guide projections 17 of the female housing 11 and extend rearward from positions slightly rearward from a front end of the hood 36. The upper guide projections 17 advance respectively into the upper guide slits 18. Two first side guide slits 15 extend rearward from the front end of the hood 36 at positions on the side wall of the hood 36 corresponding to the position of the cam pin 13 and the position of the guide rib 16 of the female housing 11. The cam pin 13 and the guide rib 16 advance respectively into the first side guide slits 15. Second side guide slits 33 extend rearward from the front end of the hood 36 at positions below the first side guide slits 15 corresponding to the positions of the retainer guide ribs 32 of the female housing 11. The guide ribs 32 advance respectively into the second guide slits 33. The two downwardly concave lower guide grooves 20 extend longitudinally at positions in a lower wall of the hood 36 corresponding to the positions of the lower guide ribs 19. The lower guide ribs 19 advance respectively into the lower guide grooves 20.

As shown in FIG. 11, cavities 21 are formed longitudinally in the terminal accommodation part 37 and male terminal fittings 23 can be inserted into the cavities 21 from the rear. Each of the male terminal fittings 23 has a body 40 and a barrel 27 disposed rearward from the body 40. The barrel 27 is configured to be caulked into engagement with an electric wire 26. A long narrow tab 24 extends forward at the front end of the body 40. An elastically deformable lance 29 is cantilevered forward on the inner wall of the cavity 21. The lance 29 elastically engages the body 40 to prevent the male terminal fitting 23 from slipping out of the cavity 21. The tab 24 projects into the hood 36 when the male terminal fitting 23 is in the cavity 21.

The retainer 30 is mounted on the front end of the terminal accommodation part 37 and enters the elastically deformable space of the lance 29 to prevent the lance 29 from deforming away from the male terminal fitting 23. Thus, each of the male terminal fittings 23 is locked redundantly.

Figure 8:
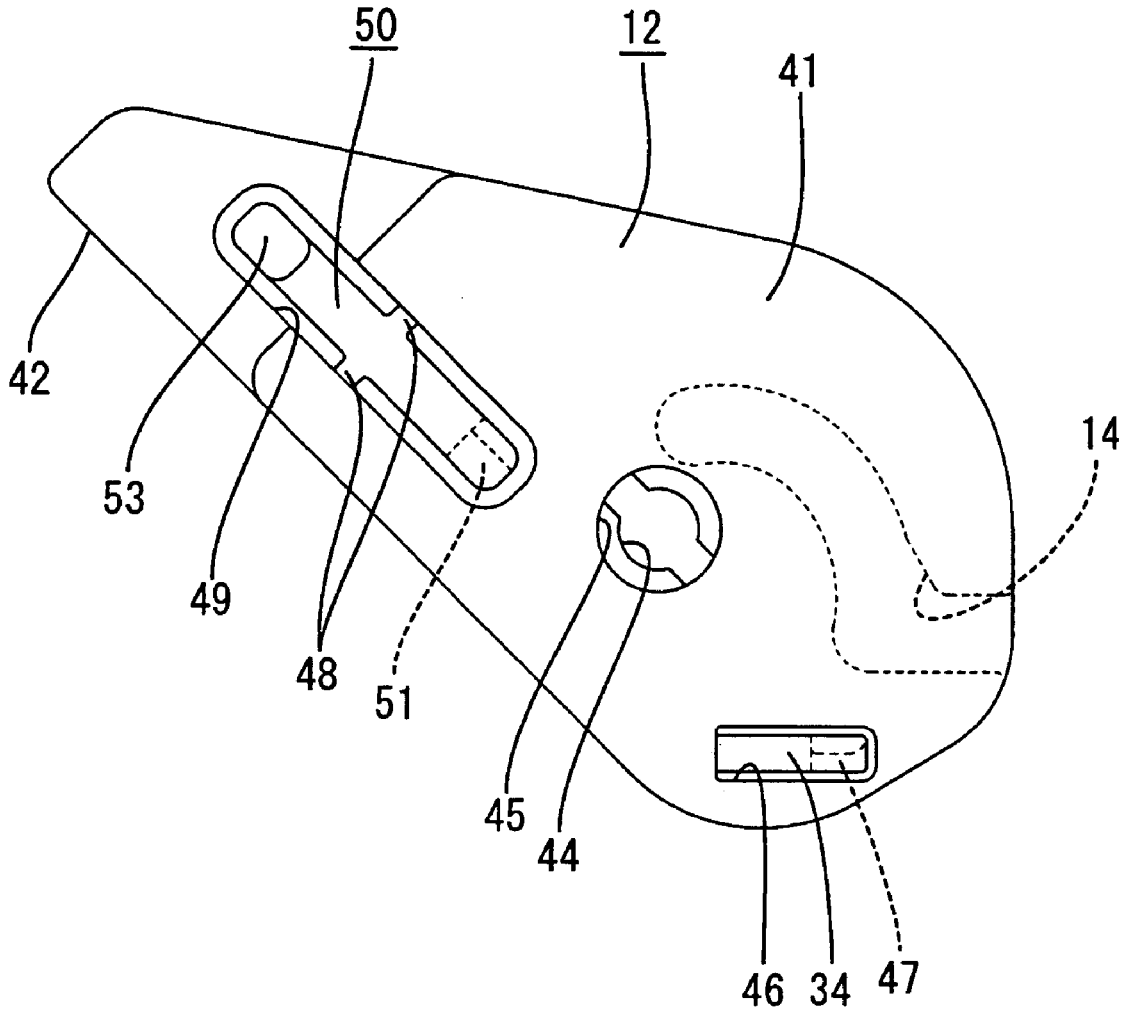
FIG. 8 is a side view showing a lever.
Figure 9:
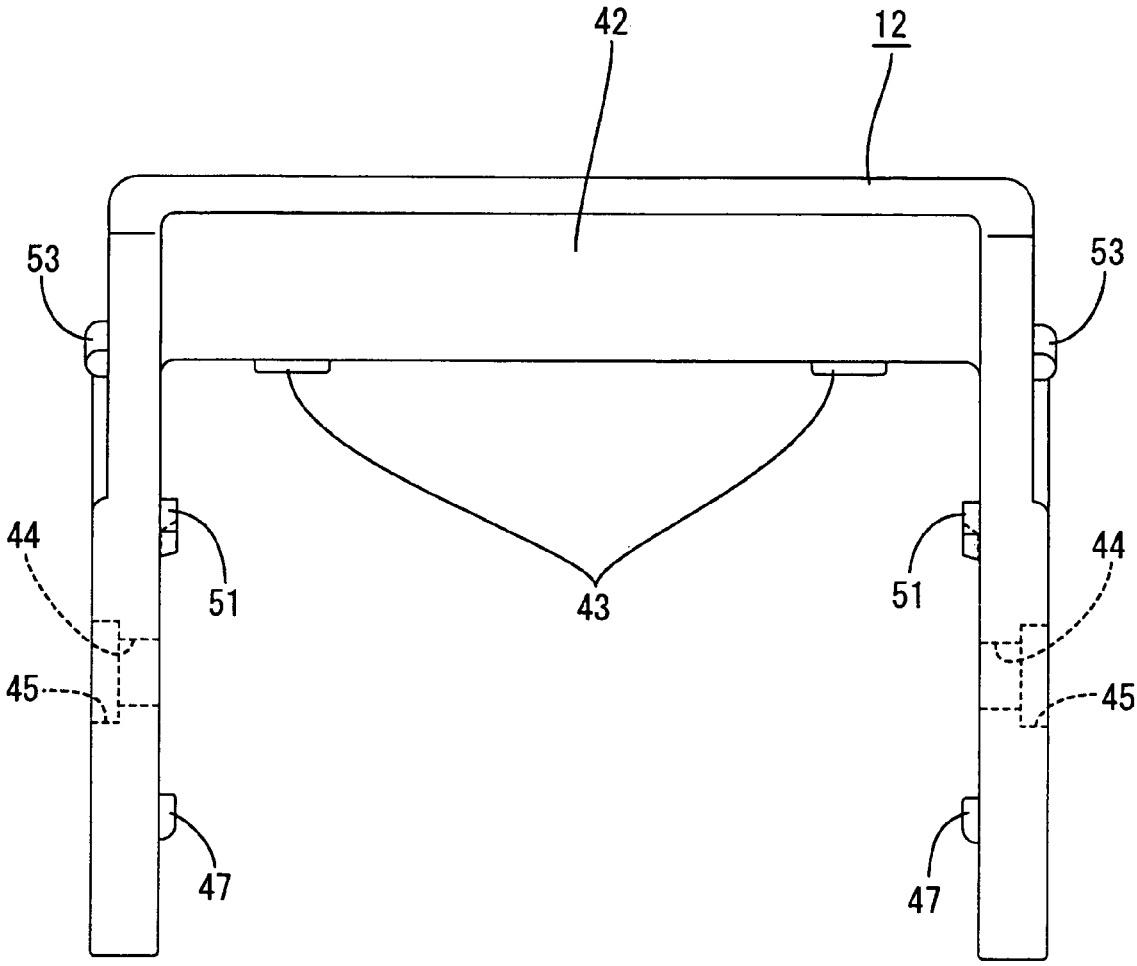
FIG. 9 is a rear view showing the lever.
Figure 10:
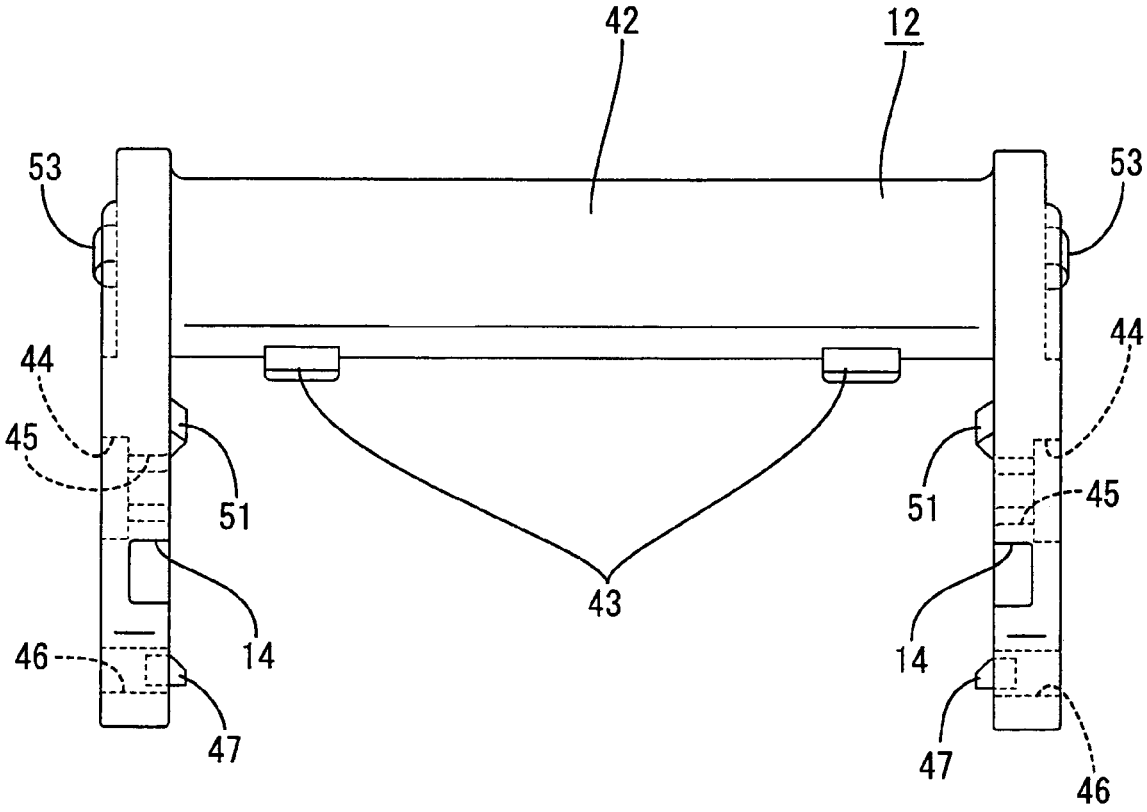
FIG. 10 is a plan view showing the lever.

As shown in FIGS. 8 through 10, the lever 12 is made of a synthetic resin and has two side plates 41 joined by a plate-shaped operation portion 42. Thus, the lever 12 is U-shaped. The lever 12 is mounted on the male housing 10 for rotation between a wait position and a fit-in position. The cam grooves 14 are formed on the side plates 41 of the lever 12 and can receive cam pins 13 formed on the female housing 11 when the lever 12 is at the wait position. The housings 10 and 11 are fit normally together when the lever 12 is at the fit-in position.

Two stoppers 43 project down from positions near the widthwise ends of a lower surface of the operation portion 42. The stoppers 43 contact the outer surface of the upper wall of the male housing 10 from above to prevent the lever 12 from rotating counterclockwise in FIG. 1 from the lever the wait position.

Shaft holes 44 penetrate the side plates 41 and receive the shafts 38 of the male housing 10. The shaft holes 44 have almost the same shape as the shaft 38. Thus, the lever 12 is rotatable about the shaft 38. A circular hole 45 is formed outside the shaft hole 44 and receives a projection 39 of the shaft 38 when the lever 12 is rotated. Although not shown in detail, a front end surface of the shaft 38 and an outer surface of the lever 12 are almost flush when the lever 12 is mounted on the male housing 10. As shown in FIG. 8, approximately circular arc-shaped cam grooves 14 are formed on inner surfaces of the side plates 41 and receive the cam pins 13 of the female housing 11. The cam pins 13 can enter the cam grooves 14 when the lever 12 is at the wait position and then move along the cam grooves 14 as the lever 12 is rotated from the wait position to the fit-in position, thereby allowing the housings 10 and 11 to be fit together.

An approximately U-shaped first slit 46 is formed in each side plate 41 at positions corresponding to the second guide slits 33 of the male housing 10 when the lever 12 is at the wait position. A temporary lock 34 (see FIG. 12) is cantilevered inside each first slit 46 and is elastically deformable towards and away from the side wall of the male housing 10. A locking claw 47 projects in at the distal end of the temporary lock 34. The locking claw 47 is locked to the second guide slit 33 when the lever 12 is at the wait position and prevents the lever 12 from rotating. The locking claw 47 of the temporary lock 34 rides over the front end of the retainer guide rib 32 of the female housing 11 when the cam pin 13 advances into the entrance of the cam groove 14. Thus, the temporary lock 34 elastically deforms away from the side wall of the male housing 10. As a result, the locking claw 47 is unlocked from the side-surface side second guide slit 33 and the lever 12 is rotatable.

An approximately annular second slit 49 is formed in each side plate 41 in a region between the shaft hole 44 and the operation portion 42. Two hinges 48 are formed at each second slit 49. A long narrow flexible lock 50 is formed inside the second slit 49 within the thickness of the side plate 41 and within the rotational locus of the lever 12. The flexible lock 50 extends along the surface of the operation portion 42 and is aligned along a direction extending from the operation portion 42 to the shaft hole 44. The hinges 48 are disposed in the vicinity of the center of the flexible lock 50 in the longitudinal direction thereof. The flexible lock 50 is seesaw-shaped and is elastically deformable about the hinges 48 towards and away from the male housing 10. A lock 51 projects inward in the thickness direction of the side plate 41 from the inner side of an end portion of the flexible lock 50 near the shaft hole 44. The lock 51 engages a lock receiving groove 52 when the lever 12 is at the fit-in position. The lock receiving groove 52 extends longitudinally from the outer surface of the side wall of the male housing 10 at a position corresponding to the lock 51. Thus, the lever 12 is locked non-rotatably. An unlocking portion 53 is formed on the outer surface of an end of the flexible lock 50 near the operation portion 42. The unlocking portion 53 is nearer to the operation portion 42 than to the shaft hole 44 in the region between the operation portion 42 and the shaft hole 44. The flexible lock 50 can be pivoted about the hinges 48 by pressing the unlocking portion 53 towards the side wall of the male housing 10. As a result, the locking portion 51 at the end of the flexible lock 50 is displaced away from the side wall of the male housing 10 and is unlocked from the lock-receiving portion 52 of the male housing 10 so that the lever 12 can rotate.

Figure 1:
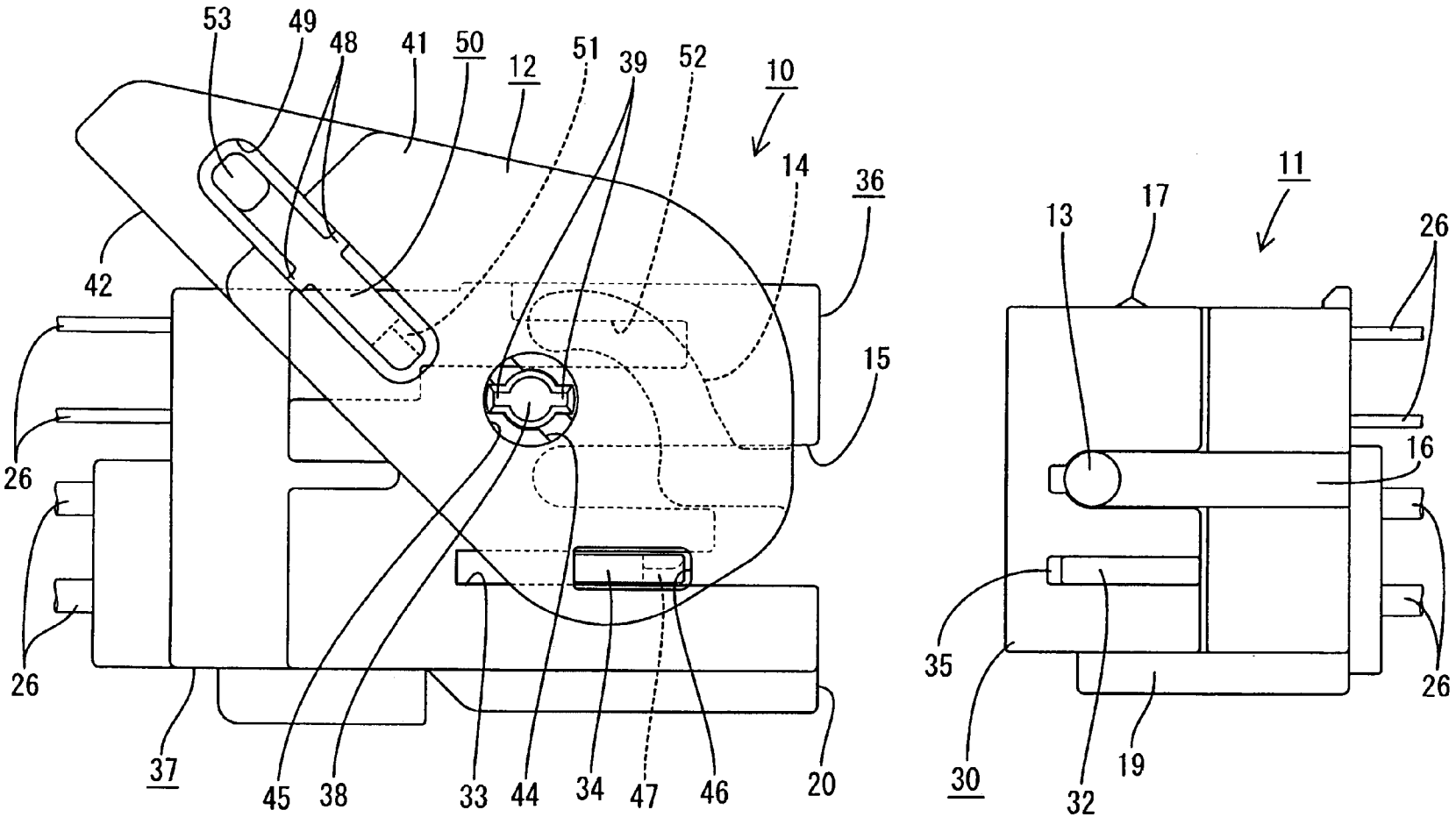
FIG. 1 is a side view showing a male housing on which a lever is mounted and a female housing.

In the state shown in FIG. 1, the female terminal fitting 22 is inserted into the cavity 21 of the female housing 11 and locked by the lance 29. The female terminal fitting 22 then is locked doubly by the retainer 30 on the female housing 11. Similarly, the male terminal fitting 23 is inserted into the cavity 21 of the male housing 10 and locked to the lance 29. The male terminal fitting 23 then is locked doubly by the retainer 30 on the male housing 10. The locking claw 47 of the temporary lock 34 of the lever 12 on the male housing 10 is locked to the side-surface side second guide slit 33, and the stopper 43 contacts the outer surface of the upper wall of the male housing 10. As a result, the lever 12 is held non-rotatably at the wait position. In this state, the entrances of the cam grooves 14 of the lever 12 and the first guide slits 15 of the male housing 10 open forward in a matching state. Thus the cam pins 13 of the female housing 11 can advance into the cam grooves 14 and the first guide slits 15.

Figure 12:
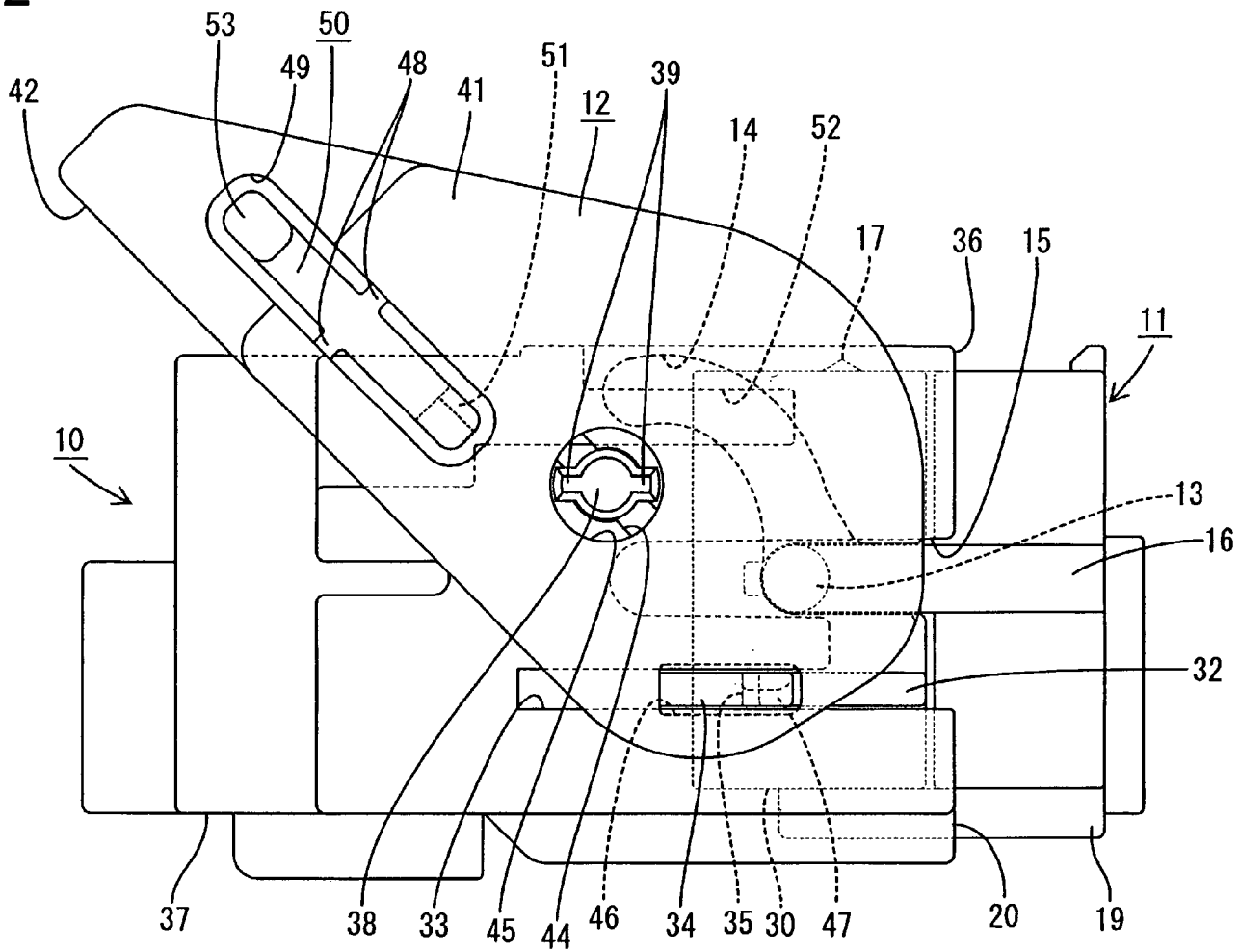
FIG. 12 is a side view showing an initial state in fitting the female and male housings in each other.

The housings 10 and 11 are moved to the position shown in FIG. 12 so that the cam pins 13 advance into the cam grooves 14 of the lever 12 and the first guide slits 15 of the male housing 10. At this time, the side guide ribs 16 advance into the first guide slits 15, the upper guide projections 17 advance into the upper guide slits 18, the lower guide ribs 19 advance into the lower guide grooves 20, and retainer guide ribs 32 advance into the second guide slits 33. In this state, each temporary lock 34 rides over the retainer guide rib 32 and elastically deforms out relative to the side wall of the male housing 10. Thus, the locking claw 47 is unlocked from the side-surface second guide slit 33 so that the lever 12 can rotate.

Figure 13:
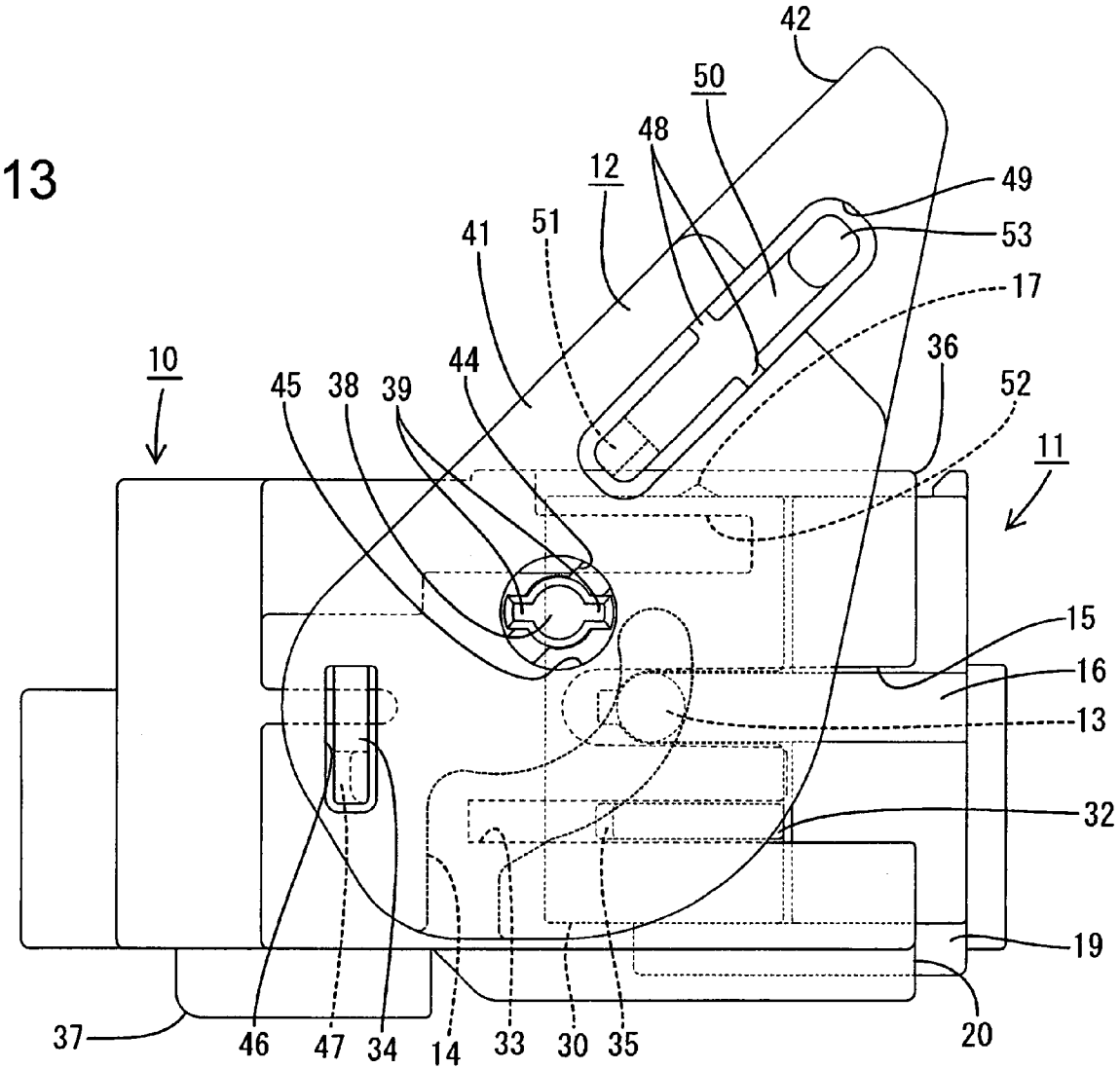
FIG. 13 is a side view showing a stage in a fit-in operation.

The lever 12 then is rotated to the position shown in FIG. 13. As a result, the cam pins 13 move to rear positions of the first guide slits 15 under the guide of the cam grooves 14 of the lever 12. Thus the male and female housings 10 and 11 are in a displaceable state and can move towards one another.

Figure 14:
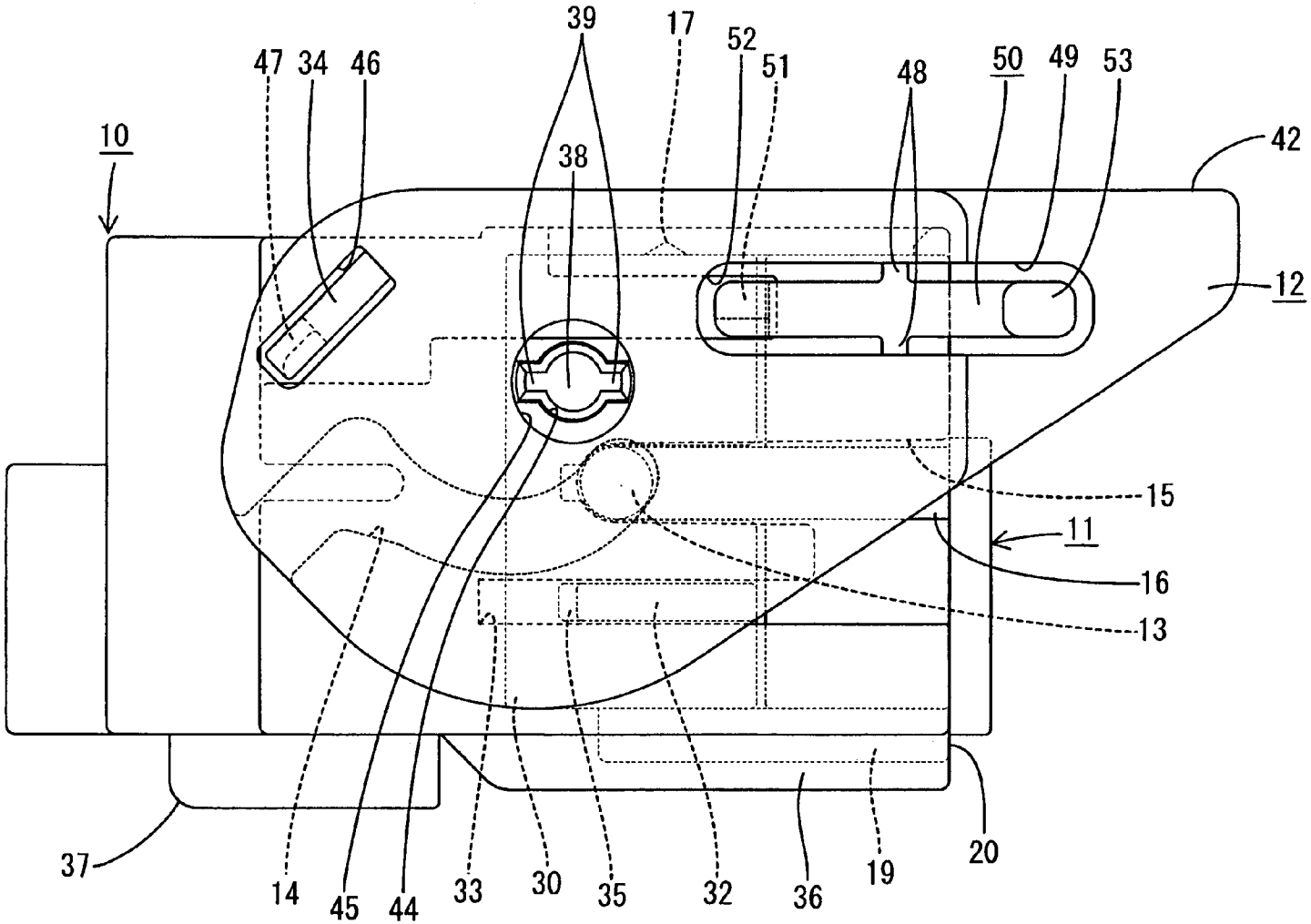
FIG. 14 is a side view showing a state in which the female and male housings have been normally fitted in each other.
Figure 15:
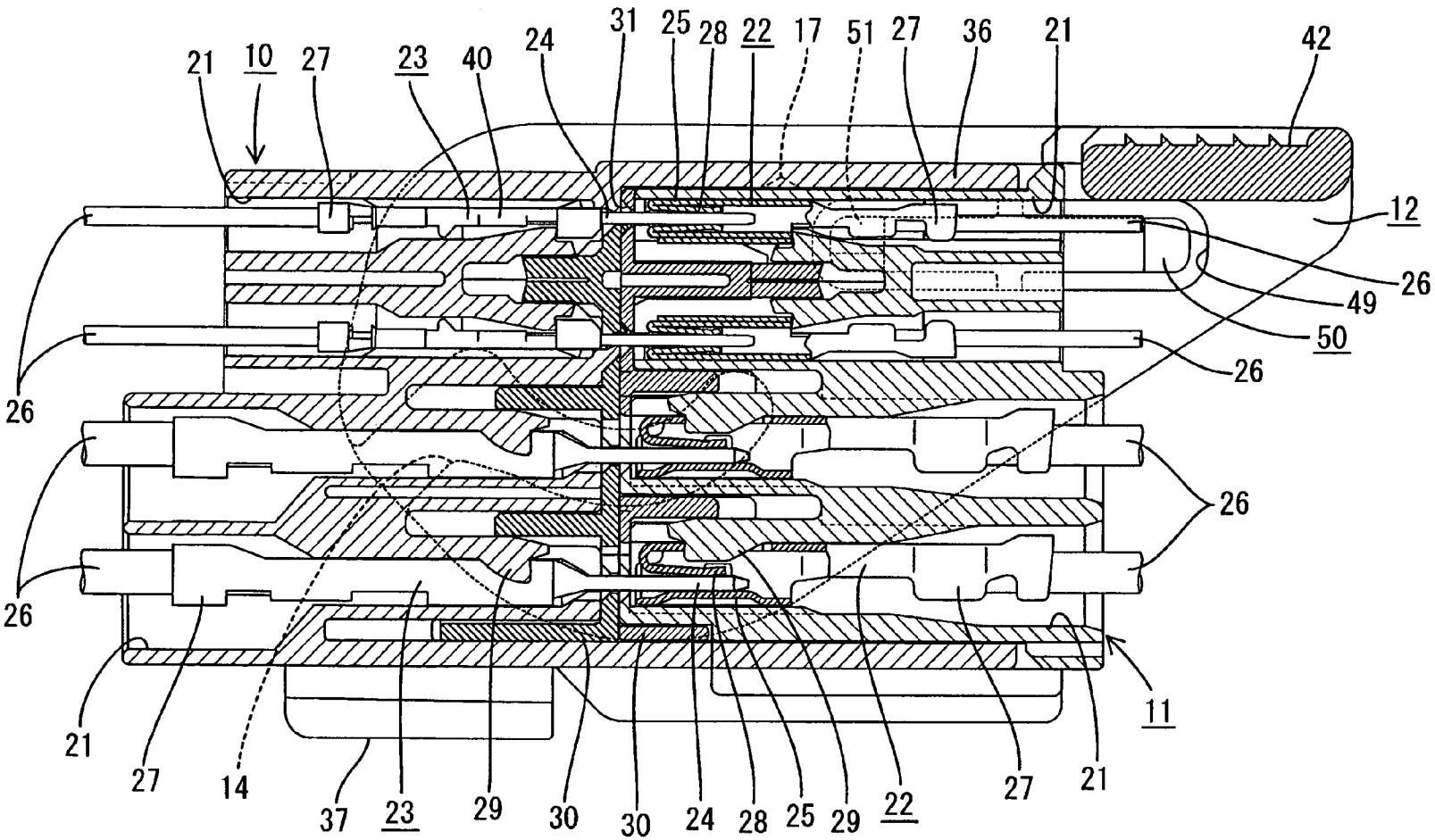
FIG. 15 is a sectional view showing the state in which the female and male housings have been normally fitted in each other.

The lever 12 then is rotated to the position shown in FIG. 14. As a result, both housings 10 and 11 are fit together and the lever 12 is at its fit-in position. At this time, the locking portions 51 of the flexible locks 50 of the lever 12 are locked to the lock-receiving portions 52 of the male housing 10. Thus, the lever 12 is held non-rotatably (see FIG. 16). The tabs 24 of the male terminal fittings 23 are inserted into the square pillar-shaped parts 25 of the female terminal fittings 22 and are connected with the elastic contact pieces 28. Thus, the male and female terminal fittings 23 and 22 are connected electrically with each other (see FIG. 15).

Figure 16:
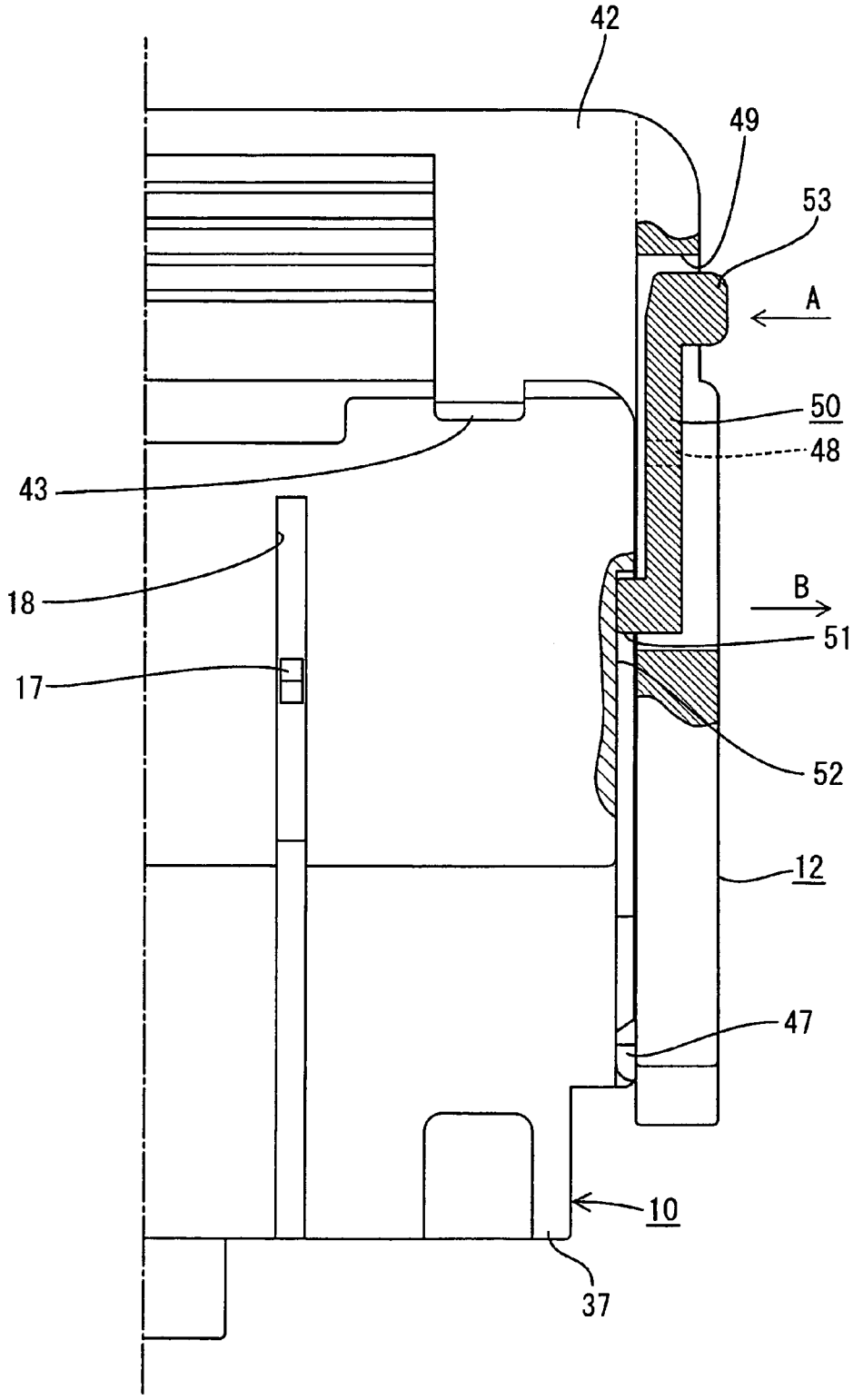
FIG. 16 is partly cut-away plan sectional view showing the state in which the female and male housings have been normally fitted in each other.

The unlocking portions 53 of the lever 12 can be pressed towards the side wall of the male housing 10, as shown by the arrow A of FIG. 16 while the lever 12 is at the position shown in FIG. 14. Thus, the locking portions 51 of the lever 12 pivot on the hinges 48 in the direction away from the side wall of the male housing 10 shown by the arrow B. As a result, the locking portions 51 are unlocked from the lock-receiving portions 52 of the male housing 10 and the lever 12 is rotatable.

Initially, the female terminal fittings 22 disposed at the end of the electric wire 26 are inserted into the respective cavities 21 from the rear while the retainer 30 is locked temporarily to the front end of the female housing 11. The lances 29 prevent the female terminal fittings 22 from slipping out of the cavities 21. The retainer 30 then is moved to the main locking position to doubly lock the female terminal fittings 22.

The lever 12 is mounted rotatably on the male housing 10, and the locking claw 47 of teach temporary lock 34 of the lever 12 is locked to the second guide slit 33 of the male housing 10 to lock the lever 12 at the wait position. The retainer 30 then is locked temporarily to the male housing 10. The male terminal fittings 23 at the ends of the electric wires 26 then are inserted into the respective cavities 21 from the rear and are held in the cavities 21 by the respective lances 29. The retainer 30 then is moved to the main locking position to doubly lock the male terminal fittings 23.

The male and female housings 10 and 11 are displaced from the state shown in FIG. 1 to the state shown in FIG. 12 so that the front end of the female housing 11 advances into the hood 36 of the male housing 10. The cam pins 13 of the female housing 11 advance into the first guide slits 15 of the male housing 10 and the cam grooves 14 of the lever 12 as the housings 10 and 11 approach each other. The lower guide ribs 19 of the female housing 11 also advance into the lower-surface guide grooves 20 of the male housing 10. As the fit-in between both housings 10 and 11 progresses, the upper guide projections 17 of the male housing 10 contact the front end of the hood 36 of the female housing 11. At this time, the front ends of the retainer guide ribs 32 contact the locking claws 47 of the temporary locks 34 of the lever 12. A force is applied in this state in a direction in which both housings 10 and 11 approach each other. As a result, the upper wall of the hood 36 deforms elastically and moves over the upper guide projections 17, and the upper guide projections 17 then advance into the upper guide slits 18. As a result, the housings 10 and 11 are displaced into the state shown in FIG. 12. At this time, the locking claws 47 of the temporary locks 34 ride across the tapered surfaces 35 of the retainer guide ribs 32 and ride over the retainer guide ribs 32, thus elastically deforming in the direction in which the locking claws 47 move away from the side walls of the male housing 10. Accordingly, the locking claws 47 are unlocked from the second guide slit 33 so that the lever 12 can rotate.

The lever 12 is rotated clockwise in FIG. 12, while the operation portion 42 is being gripped. As a result, the cam pins 13 move along the cam grooves 14 and to rear positions of the first guide slits 15 of the male housing 10. Thus, both housings 10 and 11 approach each other in a direction in which the fit-in therebetween progresses. At this time, the guide ribs 16, 19, 32, and the upper guide projections 17 advance into the corresponding guide slits 15, 18, 82, and the lower guide grooves 20 respectively, thereby stabilizing the posture of both housings 10 and 11 and guiding the fit-in therebetween (see FIG. 13).

The lever 12 is rotated further so that the locking portions 51 of the flexible locks 50 of the lever 12 contact the widthwise ends of the outer surface of the upper wall of the male housing 10 from above. When the lever 12 is rotated further, the locking portions 51 ride over the side wall of the male housing 10, and the flexible locks 50 deform elastically in the direction in which the flexible locks 50 move away from the side wall of the male housing 10. The flexible locks 50 elastically return to their original state when the lever 12 reaches the position shown in FIG. 14. Thus, the locking portions 51 are accommodated in and locked to the lock-receiving portions 52 of the male housing 10, and the lever 12 is locked non-rotatably at the fit-in position. At this time, the tabs 24 of the male terminal fittings 23 and the elastic contact pieces 28 of the female terminal fittings 22 contact each other for electrically connecting the male terminal fittings 23 and the female terminal fittings 22 together.

The unlocking portions 53 of the flexible locks 50 are pressed towards the side walls of the male housing 10 to separate the male and female housings 10 and 11. As a result, the flexible locks 50 pivot on the hinges 48 so that the ends with the locking portions 51 move away from the side walls of the male housing 10. Thus, the locking portions 51 are unlocked from the lock-receiving portions 52 and the lever 12 can rotate. Thereafter the lever 12 is rotated counter-clockwise in FIG. 14, with the unlocking portions 53 being pressed. As a result, the cam pins 13 are guided along the cam grooves 14, and the first guide slits 15 are moved forward. Thus the housings 10 and 11 are displaced in a separation direction. An operator can rotate the lever 12 easily because the unlocking portions 53 of the lever 12 are nearer to the operation portion 42 than to the shaft hole 44 and in the region between the shaft hole 44 and the operation portion 42. Hence it is possible to improve the unlocking performance and to separate the male and female housings 10 and 11 efficiently for maintenance work.

As described above, the locking portions 51 for holding the lever 12 at the fit-in position are formed on the inner surfaces of the lever 12. Therefore it is possible to prevent the lock-receiving portions 52 of the male housing 10 from projecting out in the thickness direction of the lever 12, and the male housing 10 can be compact. Further each flexible lock 50 is formed in the thickness of the lever 12. Thus, the lever 12 and the entire connector can be narrow.

The annular second slits 49 are formed by cutting out the side plate 41 of the lever 12, with two hinges 48 disposed in the region between the shaft hole 44 and the operation portion 42. The flexible lock 50 is formed inside the second slit 49. Thus, the flexible lock 50 can be disposed within the thickness of the lever 12, and it is possible to prevent the rotational locus of the lever 12 and the male housing 10 from becoming large.

The present invention is not limited to the embodiment described above with reference to the drawings. For example, the following embodiments are included in the technical scope of the present invention. Further, various modifications of the embodiments can be made within a range not departing from the spirit and scope of the present invention.

In the above-described embodiment, the lever 12 is approximately U-shaped and rotates along the outer surfaces of both side walls of the male housing 10. However, the lever 12 may be approximately flat and rotated along the outer surface of one side wall of the male housing 10.

In the above-described embodiment, the male housing 10 is the first housing, and the female housing 11 is set as the second housing. However, the female housing may be the first housing, and the male housing may be the second housing.

In the above-described embodiment, the lock-receiving portion 52 formed on the male housing 10 is concave in from the outer surface of the side wall of the male housing 10. However, the lock-receiving portion 52 may project out from the outer surface of the male housing 10, and an escape groove for receiving the projection may be formed on the side plate 41 of the lever 12. In this construction, by rotating the lever 12, the projection is locked to the locking portion 51 of the flexible lock 50.

In the above-described embodiment, the flexible lock 50 is formed inside the annular second slit 49. But so long as the flexible lock 50 is formed within the thickness of the side plate 41, the flexible lock 50 may be projected from an edge of the side plate 41 along the surface thereof.

What is claimed is:

1. A lever type connector, comprising:

a first housing;

a second housing configured for mating with the first housing, at least one cam pin projecting from the second housing; and a lever mounted rotatably on the first housing and having a cam groove for receiving the cam pin on the second housing, the cam groove being configured for cooperating with the cam pin for moving the housings as the lever is rotated, a seesaw-shaped flexible lock formed on the lever and having opposite first and second ends that are displaceable towards and away from the first housing, a locking portion formed on the first end and facing towards the first housing, the locking portion being configured to lock to an outer surface of said first housing when said first and second housings are fit together.

2. The connector of claim 1, wherein the lever has at least one substantially planar side plate, the cam groove being formed in the side plate.

3. The connector of claim 2, wherein the flexible lock is formed in the side plate, and extends substantially along a plane defined by the substantially planar side plate.

4. The connector of claim 3, wherein at least a major portion of the flexible lock is substantially coplanar with the side plate in an unbiased condition of the flexible lock.

5. The connector of claim 3, wherein the lever is substantially U-shaped and has first and second substantially parallel side plates disposed on opposite respective side of the first housing, an operation portion joining ends of the first and second side plates.

6. The connector of claim 3, wherein the locking projection projects from a surface flexible lock facing towards the first housing.

7. The connector of claim 6, wherein the first housing has at least one lock receiving groove for receiving the locking portion of the flexible lock when the housings are fit together.

8. The connector of claim 3, wherein the flexible lock is formed unitarily with the side plate and is joined to remaining parts of the side plate by hinges disposed between the opposite first and second ends of the flexible lock.

9. The connector of claim 8, further comprising an unlocking portion on second end of said flexible lock and facing away from the first housing.

10. The connector of claim 9, wherein the lever and the first housing have a rotatable connection, the lever further comprising an operation portion spaced from the rotatable connection for receiving forces to rotate the lever.

11. The connector of claim 10, wherein the flexible lock is between the rotatable connection and the operation portion.

12. The connector of claim 11, wherein the unlocking portion is between the locking portion and the operation portion.

* * * * *